United States Patent [19]

Johnson et al.

[11] Patent Number: 4,554,967

[45] Date of Patent: Nov. 26, 1985

[54] EROSION RESISTANT WATERWALL

[75] Inventors: Richard C. Johnson; Leigh B. Egbert, both of Dansville, N.Y.

[73] Assignee: Foster Wheeler Energy Corporation, Livingston, N.J.

[21] Appl. No.: 550,700

[22] Filed: Nov. 10, 1983

[51] Int. Cl.[4] ..... F28F 19/00

[52] U.S. Cl. ..... 165/134.1; 165/104.16; 165/181; 122/6 A; 122/367 R; 122/4 D

[58] Field of Search ..... 122/367 R, 367 A, 367 C, 122/4 D, 6 A; 165/181, 134, 104.16, DIG. 27; 432/83, 84, 235, 238

[56] References Cited

U.S. PATENT DOCUMENTS

| | | | |
|---|---|---|---|
| 1,232,567 | 7/1917 | Keiter | 122/367 R |
| 1,518,705 | 12/1924 | Raun . | |
| 1,962,876 | 6/1934 | Reinert et al. . | |
| 2,063,229 | 12/1936 | Corriston | 122/367 R |
| 2,077,410 | 4/1937 | Harter et al. | 122/6 A |
| 2,093,686 | 9/1937 | Murray, Jr. | 165/181 |
| 2,220,944 | 11/1940 | Murray, Jr. | 122/367 R |
| 2,243,402 | 5/1941 | Trainer et al. | 122/6 A |
| 2,325,945 | 8/1943 | Fuchs | 122/367 R |
| 2,622,937 | 12/1952 | Taylor . | |
| 4,119,123 | 10/1978 | Samuels . | |
| 4,124,068 | 11/1978 | Thompson | 122/4 D |
| 4,182,581 | 1/1980 | Uehara et al. . | |

*Primary Examiner*—Albert W. Davis, Jr.
*Attorney, Agent, or Firm*—Marvin A. Naigur; John E. Wilson; Warren B. Kice

[57] ABSTRACT

An erosion resistant waterwall in which a plurality of erosion resistant stud members are attached to the exposed surface of a waterwall consisting of a plurality of spaced water tubes connected together by continuous fins. The size of the stud members relative to the tubes are such that a plurality of the stud members extend around the periphery of each exposed tubes surface in a spaced relationship in a direction perpendicular to the axis of each tube. The stud members may be in the form of steel balls or small rod members attached to the exposed surface, and a ceramic sleeve can extend around the rod members.

4 Claims, 8 Drawing Figures

EROSION RESISTANT WATERWALL

BACKGROUND OF THE INVENTION

This invention relates to a waterwall and, more particularly, to a waterwall that has been provided with a surface that is resistant to erosion caused by particulate material.

Most erosion in industrial processes occurs where large volumes of abrasive particles such as coal, catalyst, sand, shale, limestone, etc. change direction of flow via elbows, tees, separators, swirl vanes and the like. The erosion occurs as a result of low angle impingement by large volumes of the abrasive particles which move at varying velocities.

Several systems have been devised to resist this type of erosion. For example, monolithic, cement or phosphate bonded castable (and plastic) refractories held by steel anchors on about two or four-inch staggered centers, or on a hexagonal steel grid have been utilized to resist the above erosion. Also, a considerable thickness, up to several inches of the above mentioned refractories, have been installed on V-bar or S-bar anchors, and if the erosion is exceptionally severe a prefired refractory is used which is usually bolted to the steel structure.

However, the use of these refractories increase the thermal conductivity which, in many systems, seriously affects heat absorption rates to the tubular surfaces in fluidized bed boilers, for example.

It has been discovered that a steel support system is more erosion resistant than most of the monolithic cement-bonded, castable refractories discussed above that are traditionally used in studded anchor wall systems. However, if the tube enclosure walls were simply designed with a greater thickness of steel, the weight and cost increase could be prohibitive.

SUMMARY OF THE INVENTION

It is therefore an object of the present invention to provide a waterwall that is erosion resistant yet does not affect the heat absorption rates of the waterwall.

It is a further object of the present invention to provide an erosion resistant waterwall of the above type which does not prohibitively increase the weight and cost of the system.

It is a still further objection of the present invention to provide an erosion resistant waterwall in which the metal surface thickness is selectively increased in localized, erosion prone areas of the waterwall as required.

Toward the fulfillment of these and objects the waterwall of the present invention features the use of a plurality of erosion resistant stud members attached to the exposed surface of the waterwall and disposed along the waterwall in a spaced relationship. The size of the stud members relative to the waterwall tubes are such that a plurality of the stud members extend around the periphery a each exposed tube surface in a direction perpendicular to the axis of each tube.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings in which.

DESCRIPTION OF THE PREFERRED EMBODIMENTS

Figure 1:
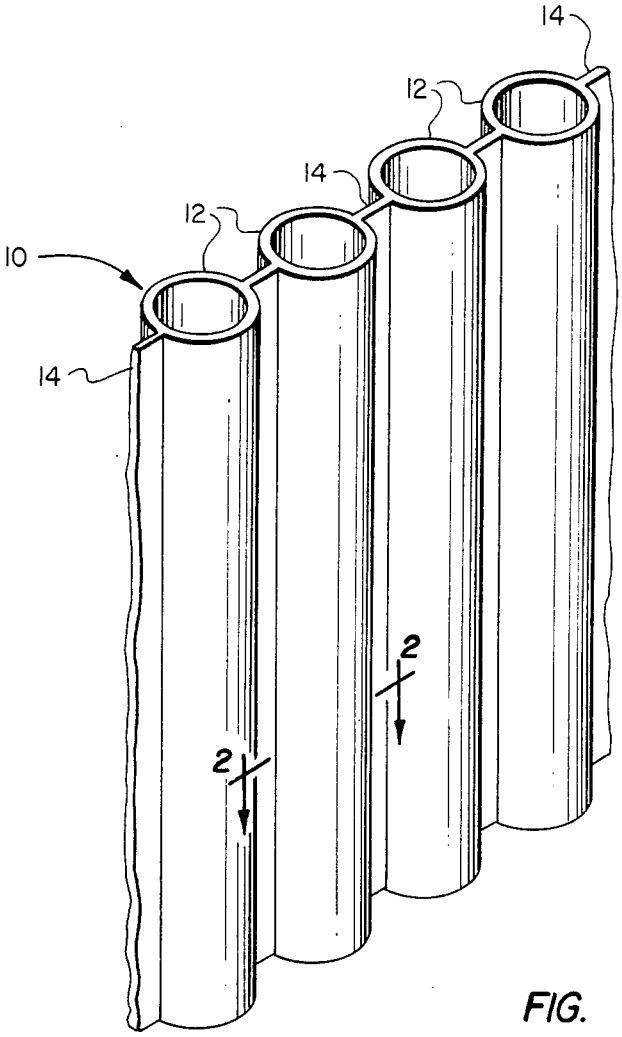
FIG. 1 is a partial, front elevational view of a conventional waterwall before being treated according to the present invention.

Referring to FIG. 1 of the drawings the reference numeral 10 refers in general to a conventional waterwall before it has been modified according to the present invention. The waterwall is formed by a plurality of spaced, parallel water tubes 12 extending for the length of the wall. A pair of continuous fins 14 extend from diametrically opposed surfaces of each tube 12. Each fin 14 is welded along its edge portion to the corresponding surfaces of the adjacent tubes 12 to form a gas tight structure.

Figure 2:
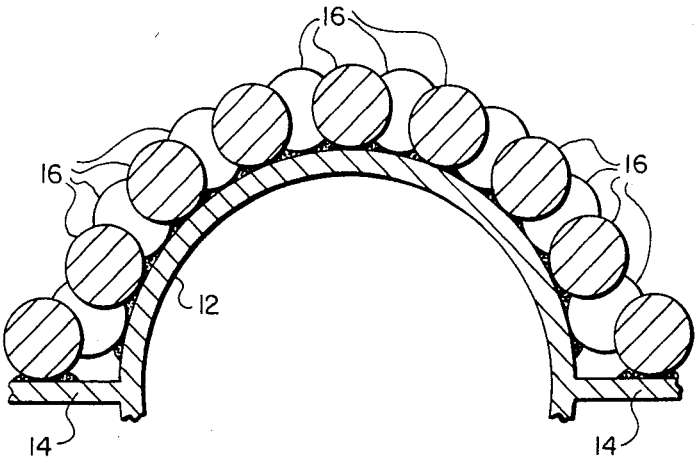
FIG. 2 is a cross-sectional view taken along the line 2—2 of FIG. 1 and depicting a portion of the waterwall surface after being treated according to the present invention.

A portion of the surface of the waterwall 10 that is exposed to heated particulate material is depicted in FIG. 2 in connection with a tube 12 and the two fins 14 extending therefrom. According to the present invention, a plurality of stud members, in the form of steel balls 16, are disposed in a spaced relationship along the exposed surfaces of the tube 12 and the fins 14. The size of the steel balls 16 relative to the tubes 12 are such that a plurality of the balls extend around the periphery of each tube surface in a spaced relationship in a direction perpendicular to the axis of the tube. The balls 16 are attached to the outer surface of the tube 12 and the fins 14 by welding in a conventional manner.

Figure 3:
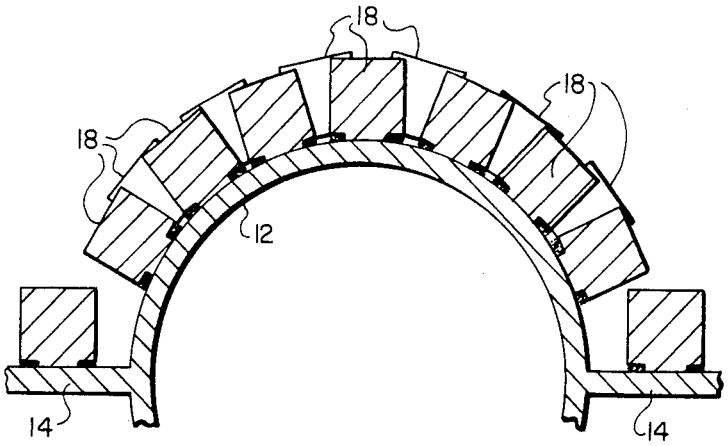
FIG. 3 is a view similar to FIG. 1 but depicting an alternate embodiment of the present invention.
Figure 4:
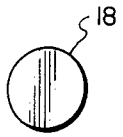
FIGS. 4 and 5 are a top plan view and a front elevational view, respectively, of one of the stud members utilized in the embodiment of FIG. 3.
Figure 5:
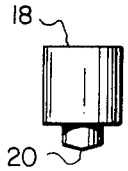

According to the embodiment of FIGS. 3–5, the stud members are in the form of solid rod portions 18 which extend around the outer exposed surface of the tube 12 and the fins 14. A projection 20 is formed on the lower surfce of each rod member 18, as shown in FIG. 5, which melts during the process of welding the rod members to the exposed surfaces of the tube 12 and fins 14.

Figure 6:
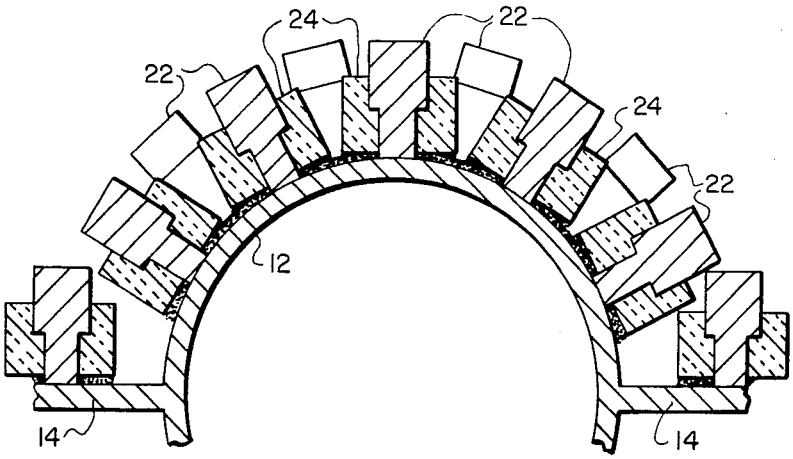
FIG. 6 is a view similar to FIG. 2 but showing another alternative embodiment invention.
Figure 7:
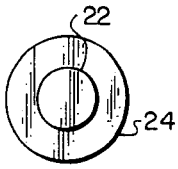
FIG. 7 is a top plan view of the stud member utilized in the embodiment of FIG. 6.
Figure 8:
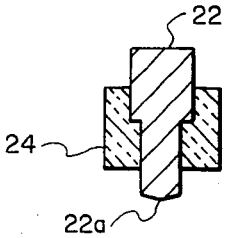
FIG. 8 is a vertical cross-sectional view taken of the stud member of FIG. 7 before it is welded to the waterwall to form the assembly shown in FIG. 6.

According to the embodiment of FIGS. 6, the stud members are formed by an inner, rod-like member 22 surrounded by a ceramic sleeve 24. A portion **22*a* of the inner member 22 projects downwardly from the ceramic sleeve 24 for melting during welding of the stud member to the exposed surface of the tube 12 and the fins 14. The inner members 22 thus functions to anchor the ceramic sleeves down in the position shown in FIG. 6 and, in addition, provides steel to weld the stud member, including the ceramic sleeve 24 to the outer exposed surface of the tube 12 and the fins 14**.

It is understood that, with exception of the ceramic sleeve in the embodiment of FIG. 6, the stud members in each of the foregoing embodiments are preferably made of steel which is welded to the exposed surfaces of the waterwall 10 as described.

Although only one tube 12 and its corresponding fins 14 have been shown in FIGS. 2, 3 and 6, it is understood that the stud members can extend over the entire exposed surface of the waterwall 10 as needed.

According to a preferred embodiment the diameter of each tube is at least five times greater than the diameter of the stud members and the spacing between adjacent stud members is between one-fourth of an inch to one inch. For example, the diameter of a tube 12 can be three inches while the diameter of each stud member is one-half inch, it being understood that these dimensions can vary with different designs.

The arrangement of the present invention enjoys several advantages. For example, the irregular shape formed by the stud members in each of foregoing embodiments disrupts the abrasive particulate flow and lowers the erosive potential when the particles impact with each other or are deflected away from the underlying structure. The closely spaced stud members may also serve as traps for the particulate material which protects the underlying steel in the areas of severe erosive activity.

All of the foregoing is achieved without significantly reducing the heat absorption rates of the waterwall and is ideally suited for field repairs and installation in areas with obvious high erosion rates. It is understood that, according to present invention, if heat transfer is not a factor the spaces between the stud members may be filled with a moderately erosion resistant aluminaphosphate bonded monolith which can be replaced if necessary during annual outages.

Other modifications, changes, and substitutions are intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A waterwall comprising a plurality of water tubes extending in a spaced, parallel relationship; a plurality of continuous fins extending between adjacent tubes for the length thereof and connected to the outer surfaces of said tubes for forming a gas-tight structure, one surface of which is exposed to erosion-causing particulate material; and a plurality of erosion resistant stud members welded to said exposed surface of said structure, each stud member comprising a cylindrical member, a projecting portion extending from said cylindrical member and having a diameter less than that of said cylindrical member for melting during said welding, and a ceramic sleeve extending around said cylindrical member and said projecting portion; the size of said stud members relative to said tubes being such that a plurality of said stud members extend around the periphery of each exposed tube surface in a spaced relationship.

2. The waterwall of claim 1 wherein said stud members extend in spaced rows with the stud members of each row being staggered relative to the stud members in adjacent rows.

3. The waterwall of claim 1 wherein the diameter of each of said tubes is at least five times greater than the diameter of said stud members.

4. The waterwall of claim 1 wherein the diameter of each of said tubes is approximately three inches and the diameter of each of said stud members is approximately one-half inch.

* * * * *